US010704360B2

(12) United States Patent
Poluchalla et al.

(10) Patent No.: US 10,704,360 B2
(45) Date of Patent: Jul. 7, 2020

(54) ACTIVE FLOW CONTROL WITH DUAL LINE MULTIZONE HYDRAULIC POWER DISTRIBUTION MODULE

(71) Applicant: Schlumberger Technology Corporation, Sugar Land, TX (US)

(72) Inventors: Srinivas Poluchalla, Katy, TX (US); Virinchi Mallela, Novi, MI (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 245 days.

(21) Appl. No.: 15/471,898

(22) Filed: Mar. 28, 2017

(65) Prior Publication Data

US 2018/0283136 A1 Oct. 4, 2018

(51) Int. Cl.
*E21B 34/10* (2006.01)
*E21B 43/14* (2006.01)

(52) U.S. Cl.
CPC ..... *E21B 34/10* (2013.01); *E21B 43/14* (2013.01)

(58) Field of Classification Search
None
See application file for complete search history.

(56) References Cited

U.S. PATENT DOCUMENTS 3,200,425 A * 8/1965 Vickers ..... B23G 1/16 408/130
5,896,928 A * 4/1999 Coon ..... E21B 43/12 166/205
2002/0157837 A1* 10/2002 Bode ..... E21B 23/006 166/373
2006/0192160 A1* 8/2006 Cove ..... E21B 33/035 251/62
2007/0056745 A1* 3/2007 Contant ..... E21B 23/04 166/382
2011/0284241 A1* 11/2011 Mandrou ..... E21B 23/04 166/375
2012/0278053 A1* 11/2012 Garcia ..... E21B 43/00 703/10
2015/0027724 A1* 1/2015 Symms ..... E21B 34/16 166/373
2016/0053575 A1* 2/2016 Grubert ..... E21B 43/12 166/305.1
2017/0192125 A1* 7/2017 Pearl, Jr. ..... E21B 47/1005

* cited by examiner

*Primary Examiner* — Shane Bomar

(57) ABSTRACT

A controllable, multi-zone control system is provided for controlling the inflow of fluids into a completion, e.g. a lateral completion, at a plurality of well zones. According to an embodiment, flow control devices are distributed along the completion and a control module is positioned between the flow control devices, e.g. in a middle region of the completion. The control module is supplied with hydraulic actuating fluid and is electrically controllable to enable selective distribution of the hydraulic actuating fluid to selected flow control devices via a hydraulic actuating line and a hydraulic return line. The control module may be controlled via electric signals, thus controlling distribution of hydraulic actuating fluid under pressure to selected flow control devices so as to shift the selected flow control devices to a desired flow positions.

19 Claims, 2 Drawing Sheets

ACTIVE FLOW CONTROL WITH DUAL LINE MULTIZONE HYDRAULIC POWER DISTRIBUTION MODULE

BACKGROUND

Open hole horizontal completions have been used in the oil and gas industry for hydrocarbon extraction in both sandstone and carbonate formations. To combat early well failure due to sand screen plugging or sand breakthrough, completions have been combined with gravel packs to filter out the sand. Additionally, a lower completion string often is combined with an upper completion string via a connect-disconnect system. The upper completion string may be combined with an electric submersible pumping system, and this configuration allows operators to change out the electric submersible pumping system during maintenance. The electric submersible pumping system is used to produce well fluids which flow from the surrounding formation into the lower completion. However, obtaining a desired level of control over the inflow of fluids with respect to a plurality of zones along a horizontal wellbore has been difficult.

SUMMARY

In general, a system and methodology provide a multi-zone control system for controlling the inflow of fluids into a completion, e.g. a lateral completion, at a plurality of well zones. According to an embodiment, flow control devices are distributed along the completion and a control module is positioned between the flow control devices, e.g. in a middle region of the completion. The control module is supplied with hydraulic actuating fluid and is in fluid communication with each of the flow control devices via a pair of hydraulic lines which may be referred to as a hydraulic actuating line and a hydraulic return line. The control module is electrically controllable and may be actuated according to electrical control signals to provide selective distribution of the hydraulic actuating fluid to specific flow control devices. The hydraulic actuating line and the hydraulic return line enable controlled shifting of specific flow control devices to desired open flow, closed flow, or choked flow positions.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
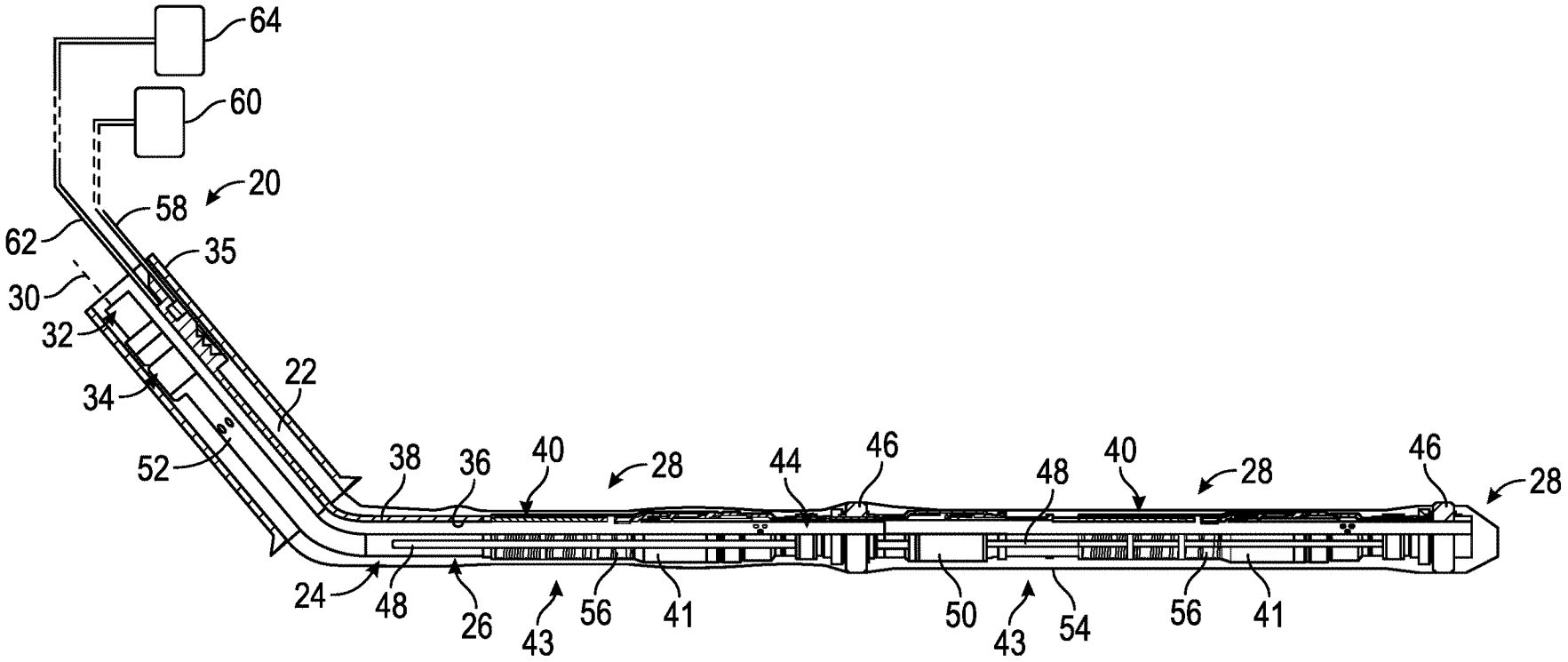
FIG. 1 is an illustration of an example of a completion deployed in a lateral wellbore and combined with a multi-zone control system, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to an electrically controllable, multi-zone control system. The multi-zone control system may be used for controlling the inflow of fluids into a completion, e.g. a lateral completion, at a plurality of well zones. According to an embodiment, hydraulically actuated, flow control devices are distributed along the completion in the various well zones. Additionally, a control module is positioned between the flow control devices, e.g. in a middle region of the completion. For example, the control module may be positioned between well zones and operated downhole for controlling flow control devices uphole and downhole relative to the location of the control module.

The control module is supplied with hydraulic actuating fluid from a source, such as a downhole hydraulic fluid source or a surface source. In operation, the control module is electrically controllable to enable selective distribution of the hydraulic actuating fluid to specific flow control devices, e.g. flow control devices in a specific well zone. The control module may be actuated via electric signals to provide controlled distribution of hydraulic actuating fluid via a pair of hydraulic lines to selected flow control devices.

For example, the control module may receive electrical control signals via a single electric line. Based on those electrical control signals, the control module distributes hydraulic actuating fluid along a hydraulic actuating line and a hydraulic return line to a specific flow control device or devices. Use of the hydraulic actuating line and hydraulic return line enable controlled shifting of the selected flow control devices to desired open flow, closed flow, or choked flow positions, thus providing a great degree of control over the inflow of fluids from an exterior to an interior of the well completion.

Effectively, the control module serves as a multi-zone distribution hub. In some embodiments, the control module is supplied with hydraulic actuating fluid via a single hydraulic control line. The hydraulic control line is a supply line that may be routed from, for example, a surface source or a downhole source. For example, the hydraulic actuating fluid may be supplied from a downhole reservoir, and a pump may be used to place the actuating fluid under suitable pressure for actuating the flow control devices.

An electric line may be routed downhole to the control module to provide electrical signals causing the control module to direct hydraulic actuating fluid through relatively short hydraulic lines to specific flow control devices. As a result, a single electric line may be routed downhole and used to selectively control operation of flow control devices in a plurality of well zones, e.g. three well zones. Use of the electric line enables and simplifies active surface control of fluid flow into the completion at a plurality of downhole well zones. The electric line also enhances the ability to multi-drop such a system to various other well zones.

Referring generally to FIG. 1, an embodiment of a well system 20 is illustrated. In this embodiment, well system 20 is deployed in a wellbore 22 having a lateral wellbore section 24, e.g. a generally horizontal wellbore section. The well system 20 comprises a completion 26 deployed in wellbore 22. In a variety of applications, completion 26 may be in the form of a lateral completion deployed in lateral wellbore section 24 along a plurality of well zones 28.

In some applications, the lateral completion 26 is a lower completion initially installed downhole and then coupled with an upper completion 30 (shown in dashed lines) via a connect-disconnect system 32. An artificial lift system, e.g. an electric submersible pumping system, may be deployed as part of or in cooperation with the upper completion 30 to produce fluids received via lateral completion 26. During a production operation, the lateral wellbore section 24 may be isolated via a packer 34, such as a production packer, set against a surrounding casing 35.

Lateral completion 26 comprises an interior flow region or passage 36 which may be along the interior of a base pipe 38. The lateral completion 26 also comprises a plurality of sand screens 40 disposed about the base pipe 38 and located in corresponding well zones 28. Additionally, the lateral completion 26 comprises a plurality of flow control device systems 41. Each flow control device system 41 may comprise a plurality of flow control devices 42 located in each well zone 28, as further illustrated in FIG. 2. In a variety of applications, the lateral completion 26 is assembled by connecting sections which may be referred to as joints 43. For example, sand screen assembly joints 43 may be sequentially joined and deployed along lateral wellbore 24.

Figure 2:
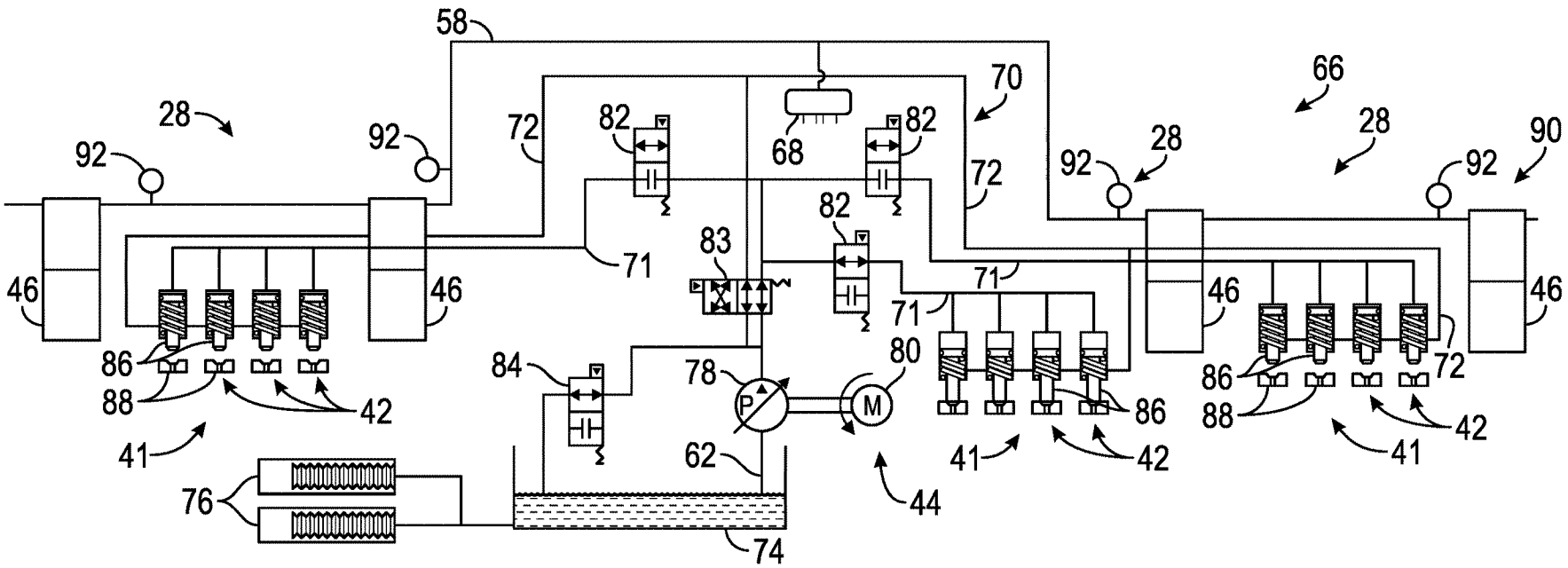
FIG. 2 is a schematic illustration of an example of a multi-zone control system utilizing a control module combined with a plurality of flow control devices, according to an embodiment of the disclosure.

Referring to both FIG. 1 and FIG. 2, the flow control devices 42 are uniquely controlled via a control module 44. The control module 44 effectively enables control of fluid flow from an exterior of lateral completion 26 to an interior of lateral completion 26 at specifically selected well zones 28. In a variety of applications, the control module 44 may be located between sand screens 40 and between well zones 28, e.g. at a generally central or middle location with respect to the plurality of well zones 28. In other words, the control module 44 is positioned such that at least one of the flow control devices 42 is uphole and at least one of the flow control devices 42 is downhole relative to the location of the control module 44. It should be noted uphole refers to the side of the module 44 toward the surface regardless of whether the lateral wellbore 24 is horizontal or inclined. The downhole side of control module 44 is the opposite side which is farther into the wellbore relative to the control module. The well zones 28 may be separated and isolated via isolation packers 46 which are deployed in an un-set state and then set against the surrounding open hole wellbore wall, as illustrated.

In some embodiments, the control module 44 is hydraulically coupled with the flow control devices 42 via hydraulic lines channeled to various well zones 28 and connected to flow joints 43 between sand screens 40. The flow joints 43 may be preassembled at the surface with known pressure drop parameters across the flow control devices 42. In some applications, the flow control devices 42 may be concentrated in the heel area of the wellbore.

To facilitate an initial gravel packing of lateral wellbore 24, the completion 26 also may comprise a plurality of shunt tubes 48 which deliver the gravel packing slurry to sequential well zones 28. The shunt tubes extending through sequential well zones 28 may be joined at a shunt tube isolation valve structure 50 having valves for controlling the flow of gravel slurry. The valves in valve structure 50 serve to further isolate adjacent well zones 28 when the valves are closed, e.g. closed after gravel packing. During a gravel packing operation, gravel packing slurry is delivered downhole by a service tool and then diverted from the inside diameter to the annulus surrounding completion 26 via a port closure sleeve 52. The gravel slurry flows along the annulus and shunt tubes 48 to form a uniform gravel pack 54.

In an operational example, the gravel slurry begins packing from the heel of the well and as the gravel/sand settles the dehydration fluid travels along a drainage layer between the first sand screen 40 and a solid section of the base pipe 38. The dehydration fluid travels along this fluid return path until reaching a first sliding sleeve 56 of a plurality of sliding sleeves 56. In various applications, at least some of the returning dehydration fluid also flows through the corresponding flow control device system 41, thus reducing or removing the use of additional sliding sleeves 56. The dehydration fluid then flows into interior 36 and back to the surface through the base pipe 38 and corresponding tubing.

Upon completion of the heel zone, the gravel slurry pumping operation is continued and this process is repeated at subsequent well zones 28, with the aid of shunt tubes 48, until screen out pressure is reached and the pumps are stopped. In some embodiments, the service tool may be used to close the sliding sleeves 56 before being removed. Once the sliding sleeves 56 are closed, flow into the completion 26 is controlled by the flow control device systems 41 and corresponding flow control devices 42.

After the service tool is retrieved, the upper completion 30 is deployed downhole and engaged with the lower completion 26 to establish communication from the surface to the lower completion 26. For example, electrical and/or hydraulic communication may be established through the connect-disconnect 32 which can be in the form of an electrically powered connect-disconnect system. Electrical power and electrical control signals may be provided to the control module 44 via an electric line 58 routed through the connect-disconnect 32. The electric line 58 may be coupled with a control system 60, e.g. a computer-based control system, located at the surface or at another suitable location.

In some applications, hydraulic actuating fluid may be provided to control module 44 via a hydraulic line 62 to enable selective actuation of the flow control devices 42. The hydraulic line 62 may similarly be routed through the connect-disconnect 32 and coupled with a hydraulic pump and control system 64 located at the surface or at another suitable location. In other embodiments, however, the hydraulic line 62 may be routed to control module 44 from a downhole fluid reservoir as described in greater detail below.

It should be noted the electric line 58 may comprise a single or multiple conductive paths for carrying electrical power, control signals, and/or data signals, e.g. data signals from sensors or other downhole equipment. By way of example, the electric line 58 may be in the form of a single line having a plurality of conductors able to independently carry power and/or data signals between, for example, surface control 60 and control module 44. Similarly, the hydraulic line 62 may comprise a single flow path or a plurality of flow paths for carrying hydraulic actuation fluid.

Referring again to FIG. 2, a schematic illustration is provided of an embodiment of an overall multi-zone control system 66 in which the control module 44 is electrically controlled via electrical control line 58 and serves as a multi-zone distribution hub. In this embodiment, sequential well zones 28 are isolated via packers 46 and the control module 44 is located proximate the generally central well zone 28. The control module 44 may comprise control electronics 68, e.g. a controller, which receive electrical control signals via electric line 58. The controller 68 may be carried on a printed circuit board or it may be otherwise suitably configured in control module 44.

Based on the control signals received via electric line 58, the controller 68 executes flow control according to the instructions carried by the control signals. For example, the controller 68 may be used to control operation of a hydraulic manifold 70 of control module 44. As described in greater detail below, the hydraulic manifold 70 may comprise a variety of electrically controllable valves which are actuated according to instructions carried by the electrical control signals.

The control module 44/manifold 70 are thus selectively controlled to direct flows of actuating fluid to the appropriate flow control system 41 and corresponding control devices 42 via corresponding hydraulic lines such as hydraulic actuating lines 71 and hydraulic return lines 72. For example, the control module 44 may be coupled with each corresponding flow control device 42 for each corresponding group of flow control devices 42 via both a hydraulic actuating line 71 and a hydraulic return line 72. In some applications, the hydraulic return lines 72 may be combined into a common return line. The use of hydraulic actuating lines 71 and hydraulic return lines 72 enables increased control over the corresponding flow control devices 42 to allow selective actuation of the corresponding flow control devices 42 between open flow, closed flow, and intermediate choked flow positions.

In some embodiments, each pair of hydraulic lines 71, 72 is routed to a corresponding well zone 28 for controlling the simultaneous opening or closing of the group of flow control devices 42 in that specific corresponding well zone 28. For example, control instructions may be provided by control system 60 to controller 68 of control module 44 via appropriate electrical signals sent along electric line 58. In response to those instructions, the control module 44 controls hydraulic manifold 70 to ensure a flow of hydraulic actuating fluid to the appropriate flow control devices 42 in a given well zone or zones 28.

If, for example, the flow control devices 42 in the given well zone 28 are to be closed, hydraulic actuating fluid is directed along the corresponding hydraulic actuating line 71 to shift the flow control devices 42 while the corresponding hydraulic return line 72 routes return fluid flow back to a hydraulic actuating fluid source. Accordingly, if undesirable fluid, e.g. water or undesirable gas, begins to flow into the interior 36 of lateral completion 26 at a specific well zone 28, the group of flow control devices 42 in that particular well zone 28 may be choked or fully closed to reduce or block further inflow.

Depending on the type of surrounding formation and type of equipment used to construct lower completion 26, the number and length of well zones 28 may vary. By way of example, the well zones 28 may be approximately 1000 feet in length and control module 44 may be used to control 2-3 well zones 28. However, the lengths of well zones 28 may range from a few feet to thousands of feet, and the length may be the same or dissimilar from one well zone 28 to the next. Accordingly, the number of flow control devices 42 placed in each well zone 28 also may vary according to the parameters of a given application.

In the specific example illustrated in FIG. 2, the overall multi-zone control system 66 employs control module 44 to control well fluid flow at three different well zones 28. Sometimes the number of well zones 28 controlled by an individual control module 44 may be selected based on the number of control line feed throughs available at isolation packers 46. For example, if the isolation packers 46 have three control line feed throughs, then the number of well zones 28 serviced by the control module 44 may be selected based on the ability to accommodate the single electrical line 58, the hydraulic actuating line 71, and the hydraulic return line 72. If the number of feed throughs in isolation packers 46 is increased, however, the multidrop to other well zones 28 can be increased accordingly. Also, the electric line 58 may be routed to additional control modules 44 so as to enable further control over inflow of well fluids at additional well zones 28.

Referring again to FIG. 2, the illustrated embodiment of multi-zone control system 66 is constructed to supply control module 44 with hydraulic actuating fluid from a downhole reservoir 74. In some embodiments, the downhole reservoir 74 may be pressure compensated via one or more compensators 76. For example, the downhole reservoir 74 may serve as a hydraulic fluid bank for storing hydraulic actuating fluid downhole in a closed loop while being reservoir pressure or tubing pressure compensated via compensators 76.

The downhole reservoir 74 supplies hydraulic actuating fluid to control module 44 via hydraulic line 62. In the embodiment illustrated, control module 44 comprises a hydraulic pump 78 powered by a motor 80 which, in turn, may be coupled to electrical power via electric line 58. In some embodiments, the hydraulic pump 78 and the motor 80 may be combined into a single component. In the illustrated example, the hydraulic manifold 70 works in cooperation with a plurality of electrically actuated valves 82, e.g. solenoid operated valves, to control flow of hydraulic actuating fluid along hydraulic actuating lines 71.

Another electrically actuated valve 83 may be used to control the direction of flow along hydraulic actuating and hydraulic return lines 71, 72. In the embodiment illustrated, the hydraulic actuating lines 71 are joined at a common fluid line coupled with hydraulic pump 78. Similarly, the hydraulic return lines 72 are joined at a common return line routed to reservoir 74. The valve 83 is positioned to control flow at both the common return line and the common fluid line coupled with pump 78. Valve 83 controls whether hydraulic fluid is directed under pressure along the appropriate hydraulic actuating line(s) 71 to close the corresponding flow control devices 42 or along the appropriate hydraulic return lines 72 to open the corresponding flow control devices 42.

An additional electrically actuated valve 84 of control module 44 may be coupled with controller 68 and used to selectively enable flow or block flow along the common fluid return line coupled with reservoir 74. For example, valve 84 may be selectively shifted to the no-flow position to effectively lock a given set of flow control devices 42 at a specific flow position, e.g. an intermediate choked position between fully closed and fully open positions. In some embodiments, valve 83 may be provided with a recirculation setting which allows fluid pumped be a hydraulic pump 78 to recirculate back through valve 83 and valve 84 to reservoir 74. This latter configuration allows hydraulic pump 78 to continually operate and to simply return the pumped actuating fluid back to reservoir 74 when the electrically actuated valves 82 are in the closed position.

When the control module 44, e.g. controller 68, receives instructions to change the flow position of flow control devices 42 in a given well zone or zones 28, the appropriate valves 82 are shifted electrically to the desired flow or no-flow position. The additional valves 83, 84 are also controlled via controller 68 and may be shifted to appropriate corresponding positions to enable shifting of the selected flow control devices 42 to the desired position, e.g. an intermediate choked position or a closed position.

In the embodiment illustrated, the electrically actuated valve 83 has been shifted to allow pressurized actuating fluid to flow from pump 78 and through valve 83 to the appropriate hydraulic actuating line 71. In this example, two of the electrically actuated valves 82 have been shifted to a no-flow position and one of the electrically actuated valves 82 has been shifted to the open flow position to enable flow of actuating fluid to the corresponding flow control devices 42. The valve 82 illustrated as shifted to the open flow position has effectively directed actuating fluid under pressure to the flow control devices 42 in the middle well zone 28, thus shifting the corresponding flow control devices 42 to the closed flow position. When flow control devices 42 in the middle well zone 28 are closed, well fluids are prevented from flowing from the exterior of completion 26 to interior 36 at that well zone.

Depending on the application, flow control devices 42 may have a variety of configurations. By way of example, the flow control devices 42 may comprise plunger assemblies 86, e.g. hydraulically actuated plungers 86. The positioning of plungers 86 is controlled via entry and exit of actuating fluid along the corresponding hydraulic actuating line 71 and return line 72.

For example, the plungers 86 of a given group of flow control devices 42 may be moved in a closing direction as hydraulic actuating fluid is pumped into the plunger assembly via the hydraulic actuating line 71 and as return fluid leaves the plunger assembly via the hydraulic return line 72. If further inflow or outflow of fluid is stopped, the plungers 86 are held at that particular position. Consequently, the plungers 86 may be held at an intermediate position which chokes the flow of well fluid by limiting the flow through selected flow control devices 42 without stopping the flow. If hydraulic actuating fluid is allowed to continue flowing along the hydraulic actuating line 71 and corresponding hydraulic return line 72, the plungers 86 are ultimately forced to the fully closed position preventing further flow from an exterior to an interior of completion 26 at that particular well zone. It should be noted the configuration of overall flow control system 66 may be constructed to enable individualized flow control in different portions of a single well zone or well zones 28.

The use of two hydraulic lines 71, 72 extending between the control module 44 and each individual or group of flow control devices 42 located at a specific well zone 28 (or at a portion of the well zone) enables substantial zonal control over the inflow of fluids into completion 26. In addition to shifting the flow control devices 42 between open and closed positions, the flow control devices 42 at a given zone (or zone portion) are readily shifted to an intermediate choked position to provide a desired, limited inflow of fluids.

Movement to the desired intermediate choked position may be achieved by a variety of techniques, such as shifting control module valve 84 to a no-flow position. Additionally, desired choking can be achieved by controlling the amount of hydraulic actuation fluid flow or by controlling the duration of flow to the corresponding plunger assemblies 86. In some applications, the desired choking may be achieved by utilizing valves 82, 83, 84 in the form of solenoid operated valves to effectively lock fluid in the appropriate hydraulic line 71, 72. In this type of embodiment, the intermediate choked position may be selected based on timing the closing of the solenoid valves so as to lock fluid in the corresponding hydraulic lines 71 and/or 72 to prevent further motion of plungers 86.

The plunger assemblies 86 may utilize a variety of pistons or other style plungers slidably and sealably received in a corresponding cylinder. By coupling the two hydraulic lines 71, 72 to the assembly on opposite sides of the plunger 86, application of pressurized hydraulic fluid on one side of the plunger 86 while bleeding the hydraulic actuating fluid from the other side of the plunger 86 allows the plunger 86 to shift in the desired direction, e.g. a direction closing the corresponding flow control device 42.

In some embodiments, the groups of flow control devices 42 controlled by a given electrically actuated valve 82 may be positioned in a portion of one well zone 28 or may be positioned in two or more well zones 28. In other words, various patterns of flow control devices 42 across various well zones 28 may be controlled simultaneously via the corresponding valve 82 (as well as cooperating valves 83, 84). The controller 68 may thus be operated in response to electrical control signals to selectively actuate electrically actuated valves 82, 83, 84. The controller 68 can thus provide various control patterns depending on the arrangement of valves 82, 83, 84 and the routing of hydraulic lines 71, 72. The flow control configurations may be selected based on various parameters, such as parameters related to a given well, formation, well zone arrangement, equipment configuration, and/or other factors.

A sensor system 90 also may be used to optimize control over fluid flow in each of the well zones 28. By way of example, the sensor system 90 may comprise a plurality of sensors 92 positioned along completion 26 and/or at other suitable locations within well zones 28. The sensors 92 may be in the form of pressure sensors, temperature sensors, or other sensors distributed throughout the well zones 28, e.g. throughout three well zones 28 as illustrated. The sensor data, e.g. pressure and temperature data, may be sent along electric line 58 to at least one of the controller 68 or control system 60 for processing. The processed data provides information that can be used for controlling flow into completion 26 at each well zone 28. For example, if the sensor data indicates the presence of water and/or gas, the flow control devices 42 for that well zone 28 may be choked or closed to limit or block further inflow of fluid.

Figure 3:
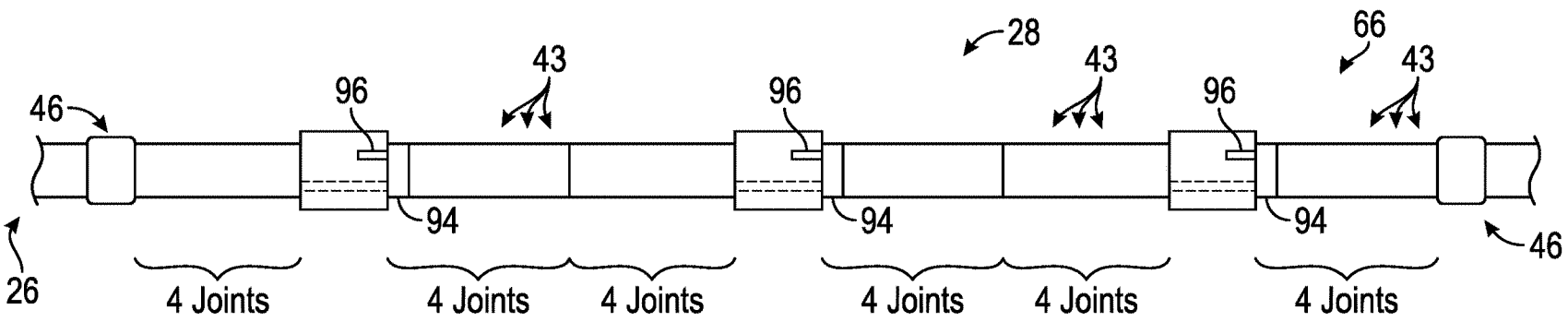
FIG. 3 is a schematic illustration of an example of lateral completion arrangement for use with a multi-zone control system, according to an embodiment of the disclosure.

Depending on the reservoir and surrounding formation, the lateral completion 26 may be constructed in various lengths and configurations. In FIG. 3, a schematic illustration is provided in which the lateral completion 26 is structured with a plurality of screen assembly joins 43, e.g. four screen assembly joints, disposed on each side of a flow manifold 94. Each flow manifold 94 houses flow control devices 42 to collect fluid flow from the drainage layer in both uphole and downhole directions. For example, each flow manifold 94 may collect fluid flow from four uphole screen joints and from four downhole screen joints. In the illustrated embodiment, twenty four screen assembly joints 43 are disposed between each pair of sequential isolation packers 46, however other numbers of screen assembly joints 43 may be used in a given application. The flow control devices 42 associated with flow manifolds 94 provide multiple flow control locations along the lateral completion 26. The number of joints 43 as well as a number of flow control devices 42 between isolation packers 46 may vary and may be selected based on, for example, zonal flow parameters.

As described above, the inflow of well fluids is collected from the screens 40 and diverted along a drainage layer of the completion 26 to the flow control devices 42, e.g. to the plunger assemblies 86, to enable selective production flow control. In various applications, the flow control system 66 may utilize manifolds 94 (which may each have a plunger assembly 96 or other suitable flow control assembly) positioned at each zone. The manifolds 94 may be used to control flow throughout the entire corresponding well zone 28 in cooperation with distributed flow control devices 42 located in desired patterns through the corresponding well zone 28.

The overall zonal flow control system 66 may be adapted to a variety of applications and may be used to provide a low-cost, active control of multiple well zones 28, e.g. five well zones, from a single distribution hub/module 44. With additional feed throughs in packers 46 and in shunt tube isolation valve structures 50, additional well zones 28 may be controlled via module 44. The control module 44 serves as a distribution hub which can be multi-dropped to provide flow control in a plurality of well zones based on control signals through the simple electric line 58. In some applications, the hydraulic actuating fluid may be selectively diverted by the control module 44 to actuate other components in the lower completion 26, e.g. packers, sliding sleeves, or zonal isolation valves. The flow control devices 42 also may comprise various types of plunger assemblies which facilitate return flow through the sand screen assembly joints 43.

Depending on parameters of a given application, the control module 44 may be constructed in a variety of configurations and may comprise various features. Examples of such features include the integral pump 78 and the motor 80 used for hydraulic power generation. The control module 44 also may incorporate or work in cooperation with a pressure compensation system, e.g. compensators 76. In some applications, the control module may comprise or work in cooperation with an accumulator used for storing hydraulic energy. Additionally, various types of electronics 68 may comprise appropriate processors and telemetry systems utilized for communication and controlling the components of control module 44 and overall control system 66.

Other components of the overall well system and multizone flow control system 66 also may be adjusted according to the parameters of a given application. The electric line 58 may comprise separate lines for power and data or a combined power/data line. The control system 60 and electric line 58 may be used for carrying a variety of signals along a wholly hardwired electrical communication line or a partially wireless communication line. Such adjustments to the well system may be made according to equipment, environmental, and/or other considerations.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a completion deployed in a lateral wellbore extending through a plurality of well zones, the completion comprising:

a plurality of isolation packers positioned to separate well zones of the plurality of well zones;

a plurality of flow control devices comprising flow control devices in each of the well zones to control flow of fluid from an exterior of the completion to an interior of the completion; and a control module hydraulically coupled with each flow control device of the plurality of flow control devices via a hydraulic actuating line and a hydraulic return line, the control module being electrically actuated to direct hydraulic actuating fluid to the flow control devices in selected well zones to enable shifting of the flow control devices in the selected well zones between open flow, closed flow, and intermediate choked flow positions, the control module being located along the completion between well zones, wherein the plurality of flow control devices comprises hydraulically operated plungers selectively shifted by the hydraulic actuating fluid to the open flow, closed flow, or intermediate choked flow positions, wherein the hydraulic actuating line and the hydraulic return line are coupled on opposite sides of the plungers and the plungers are shifted by flow of the hydraulic actuating fluid through the hydraulic actuating line and the hydraulic return line.

2. The system as recited in claim 1, wherein the completion comprises a sand screen section in each well zone.

3. The system as recited in claim 1, wherein the plurality of well zones comprises three well zones.

4. The system as recited in claim 1, wherein the source of hydraulic actuating fluid is at a surface location.

5. The system as recited in claim 1, wherein the source of hydraulic actuating fluid comprises an actuating fluid reservoir coupled with a pressure compensator.

6. The system as recited in claim 1, wherein the control module comprises a hydraulic pump to pressurize the hydraulic actuating fluid.

7. The system as recited in claim 1, wherein the control module comprises a plurality of solenoid operated valves to control flow of hydraulic actuating fluid to selected flow control devices.

8. The system as recited in claim 1, wherein the completion comprises a plurality of completion joints in each well zone.

9. A system, comprising:

a well completion disposed in a wellbore, the well completion comprising:

a plurality of flow control devices distributed in a plurality of well zones located along the wellbore; and an electrically controlled module in hydraulic communication with each flow control device of the plurality of flow control devices via a hydraulic actuating line and a hydraulic return line, the electrically controlled module configured to control flow of the hydraulic actuating fluid to each of the plurality of flow control devices, and the electrically controlled module having a manifold with electrically controlled valves which control flow of hydraulic actuating fluid through the hydraulic actuating line and the hydraulic return line to actuate selected flow control devices to desired operational flow positions.

10. The system as recited in claim 9, wherein the well completion comprises a plurality of sand screen sections having sand screens through which well fluid flows to corresponding flow control devices.

11. The system as recited in claim 10, wherein the well completion comprises isolation packers positioned to isolate well zones sequentially along the wellbore.

12. The system as recited in claim 11, further comprising a surface control system coupled to the electrically controlled module via an electric line, the surface control system providing control signals to the electrically controlled module regarding shifting selected flow control devices to closed positions or intermediate choke positions.

13. The system as recited in claim 12, further comprising a sensor system positioned along the wellbore to monitor fluid parameters in the well zones.

14. The system as recited in claim 13, wherein data from the sensor system is processed by the surface control system to facilitate determination as to whether fluid flow into the well completion should be limited in at least one of the well zones.

15. The system as recited in claim 14, wherein the electrically controlled module is positioned along the well completion with at least one well zone uphole of the electrically controlled module and at least one well zone downhole of the electrically controlled module.

16. A method, comprising:

distributing flow control devices along a wellbore completion having sand screen assembly joints;

positioning a control module along the wellbore completion such that flow control devices are disposed in an uphole direction and a downhole direction from the control module;

coupling the control module to each flow control device with a hydraulic closing line and a hydraulic opening line;

supplying the control module with hydraulic actuating fluid; and controlling the control module by electrical signals to direct the hydraulic actuating fluid to actuate selected flow control devices via the hydraulic closing line and the hydraulic opening line so as to actuate the selected flow control devices between open flow, closed flow, and choked flow positions, wherein the control module is configured to control flow of the hydraulic actuating fluid to each of the plurality of flow control devices.

17. The method as recited in claim 16, further comprising using the flow control devices to choke the flow of well fluid from an exterior of the wellbore completion to an interior of the wellbore completion by shifting plungers of corresponding flow control devices to an intermediate choke position, wherein the hydraulic opening line and the hydraulic closing line are coupled on opposite sides of the plungers and the plungers are shifted by flow of the hydraulic actuating fluid through the hydraulic opening line and the hydraulic closing line.

18. The method as recited in claim 16, wherein controlling the control module comprises actuating solenoid actuated valves in a manifold of the control module.

19. The method as recited in claim 16, further comprising locating a group of flow control devices in each well zone of a plurality of well zones along the wellbore completion.

* * * * *